US011619383B2

(12) United States Patent
Huntimer et al.

(10) Patent No.: US 11,619,383 B2
(45) Date of Patent: Apr. 4, 2023

(54) BURN BUCKET

(71) Applicant: Global Polymer Industries, Inc., Madison, SD (US)

(72) Inventors: Todd M. Huntimer, Arlington, SD (US); Michael A. Whitethorn, Madison, SD (US)

(73) Assignee: Global Polymer Industries, Inc., Madison, SD (US)

( * ) Notice: Subject to any disclaimer, the term of this patent is extended or adjusted under 35 U.S.C. 154(b) by 404 days.

(21) Appl. No.: 16/993,712

(22) Filed: Aug. 14, 2020

(65) Prior Publication Data

US 2021/0388982 A1 Dec. 16, 2021

Related U.S. Application Data

(60) Provisional application No. 63/038,705, filed on Jun. 12, 2020.

(51) Int. Cl.

| | |
|---|---|
| ***F23G 5/34*** | (2006.01) |
| ***F23G 5/44*** | (2006.01) |
| ***F23G 5/40*** | (2006.01) |

(52) U.S. Cl.

CPC ..... *F23G 5/34* (2013.01); *F23G 5/40* (2013.01); *F23G 5/44* (2013.01); *F23G 2203/601* (2013.01)

(58) Field of Classification Search

CPC ..... F23G 5/40; F23G 2203/601; B65F 1/122

See application file for complete search history.

(56) References Cited

U.S. PATENT DOCUMENTS

| | | | | |
|---|---|---|---|---|
| 2,882,842 | A * | 4/1959 | Royer | F23G 5/40 110/259 |
| 3,785,302 | A * | 1/1974 | Davis | F23G 5/34 110/215 |
| D661,856 | S * | 6/2012 | Cole | D34/1.1 |
| 2005/0011424 | A1* | 1/2005 | Ford | F23L 5/00 110/241 |
| 2006/0027150 | A1* | 2/2006 | O'Connor | F23G 5/50 110/235 |
| 2017/0283704 | A1* | 10/2017 | Olander | C10B 53/02 |
| 2018/0202687 | A1* | 7/2018 | Lucas | F24H 1/187 |
| 2019/0054475 | A1* | 2/2019 | Gabay | F23J 1/06 |

(Continued)

OTHER PUBLICATIONS

Proudpyro.com [online]. "Large Pyro Cage Incinerator 48—Bum Cage Alternative." Retrieved from the internet Jan. 7, 2021: URL <https://www.proudpyro.com/collections/pyro-cages/products/pyro-burn-cage-large?variant=42366944774>.

(Continued)

*Primary Examiner* — David J Laux

(74) *Attorney, Agent, or Firm* — Lowe Graham Jones PLLC

(57) ABSTRACT

Embodiments are directed toward a burn bucket. The burn bucket preferably includes a body, a door moveably coupled to the body, and a lifting machine interface coupled to the body. The body preferably defines an inner burn space. The lifting machine interface is preferably configured to receive a portion of a machine that tilts the burn bucket to transition the burn bucket between a closed configuration in which the door is closed and a dumping configuration in which the door is open to facilitate dumping burnt material out of the inner burn space.

19 Claims, 9 Drawing Sheets

(56) References Cited

U.S. PATENT DOCUMENTS

| | | | | |
|---|---|---|---|---|
| 2019/0277495 | A1* | 9/2019 | Ragnarsson | F23G 5/002 |
| 2020/0340669 | A1* | 10/2020 | Lucas | F23G 5/46 |
| 2021/0148570 | A1* | 5/2021 | Ragnarsson | F23G 5/40 |

OTHER PUBLICATIONS

DR Power Equipment [online]. "BurnCage, Outdoor Incinerator Burns up to 1600° Fahrenheit." Retrieved from the Internet Jan. 7, 2021: URL <https://www.drpower.com/Power-Equipment/BurnCage/BurnCage-%28Original%29/p/000000000000314490>.

Burn Right Products [online]. "Burn Barrel Home Incinerator Cage." Retrieved from the internet Jan. 7, 2021: URL <https://wwwburnrightproducts.com/product/burn-barrel-home-incinerator-cage/>.

* cited by examiner

BURN BUCKET

FIELD OF THE INVENTION

The invention relates to containers for burning scraps or debris.

BACKGROUND OF THE INVENTION

In rural, agricultural, and construction environments, burning scrap material is a common and efficient way to dispose of such material. Typically, the material is burned in a 55-gallon barrel. With each burn, the barrel accumulates more ash. The ash is eventually dumped in a pit dug in the earth by tipping the barrel over, which may be difficult and time consuming. Repeated burning and tipping wears and damages the barrel. The barrels also rust through and weaken with corrosion and repeated heating. Accordingly, 55-gallon barrels typically only last around one year when used for burning.

SUMMARY OF THE INVENTION

It is therefore an object of the present invention to provide burn containers, such as buckets, that empty responsive to being only partially tilted.

It is also an object of the present invention to provide burn buckets that achieve the above object and that also have increased durability.

It is another object of the present invention to provide burn buckets that achieve the above objects and that also facilitate easier tipping of the buckets.

It is a further object of the present invention to provide burn buckets that achieve the above objects and that also facilitate increased airflow to fires in the burn buckets.

The invention achieves the above objects, as well as other objects and advantages that will become apparent from the description that follows, by providing a burn bucket that includes a body, a door moveably coupled to the body, and a lifting machine interface coupled to the body. The lifting machine interface is preferably configured to receive a portion of a machine that tilts the burn bucket to transition the burn bucket between a closed configuration in which the door is closed and a dumping configuration in which the door is open to facilitate dumping burnt material out of the inner burn space.

The lifting machine interface preferably includes a front-loader coupler. The burn bucket preferably has a spacer that spaces the front loader-coupler apart from the body to reduce heat distortion. In some versions, the lifting machine interface includes a pair of forklift channels.

The body preferably has a floor. In the closed configuration, the floor is preferably substantially parallel to horizontal. In the dumping configuration, the floor is preferably tilted toward vertical and substantially within 80° from horizontal.

The door preferably pivotably couples to the body. The burn bucket preferably has a front surface and a rear surface. The door is preferably pivotable about an axis that is disposed between the front surface and the rear surface. In some versions, the axis is spaced apart from the rear surface and closer to the rear surface than the front surface.

The body and the door preferably form a cuboid in the closed configuration. The cuboid preferably has a front side, a rear side, a left side that extends from the rear side to the front side, and a right side that extends from the rear side to the front side. The door preferably defines the front side, approximately half the left side, and approximately half the right side.

The door preferably has a front portion, a left side portion that extends rearward from the front portion, and a right-side portion that extends rearward from the front portion. Each of the left and right-side portions preferably has a lower edge portion that has an interface flange to reduce heat distortion. In some versions, the interface flanges are disposed at approximately 60°.

The door preferably has a lower edge portion that has an outwardly extending flange and a flange that extends downward from the outwardly extending flange to reduce heat distortion.

The body preferably has a floor. The floor preferably has a front edge portion that has an interface flange to reduce heat distortion.

The body or the door preferably has a plurality of corrugations disposed spaced apart from each other in a row and substantially parallel to each other. In some versions, two of the corrugations both extend in an outward or inward direction and one of the corrugations is disposed between the two corrugations and extends in an opposite inward or outward direction from the two corrugations. Each outwardly extending corrugation preferably has an upper portion that defines a plurality of openings to facilitate providing airflow to a fire in the inner burn space and a lower portion that is devoid of openings. Each inwardly extending corrugation preferably has a lower portion that defines a plurality of openings to facilitate providing airflow to the fire and an upper portion that is devoid of openings.

The burn bucket preferably includes a screen lid moveably coupled to the door and selectively providing access to the inner burn space to facilitate placing burnable material in the inner burn space. Each of the body and the door preferably has an upper edge portion that has a flange that defines a support surface on which the screen lid rests in the closed configuration.

The body and the door are preferably devoid of welds.

BRIEF DESCRIPTION OF THE DRAWINGS

Preferred embodiments of the present invention are described in detail below with reference to the following drawings.

DETAILED DESCRIPTION OF THE PREFERRED EMBODIMENT

Figure 1:
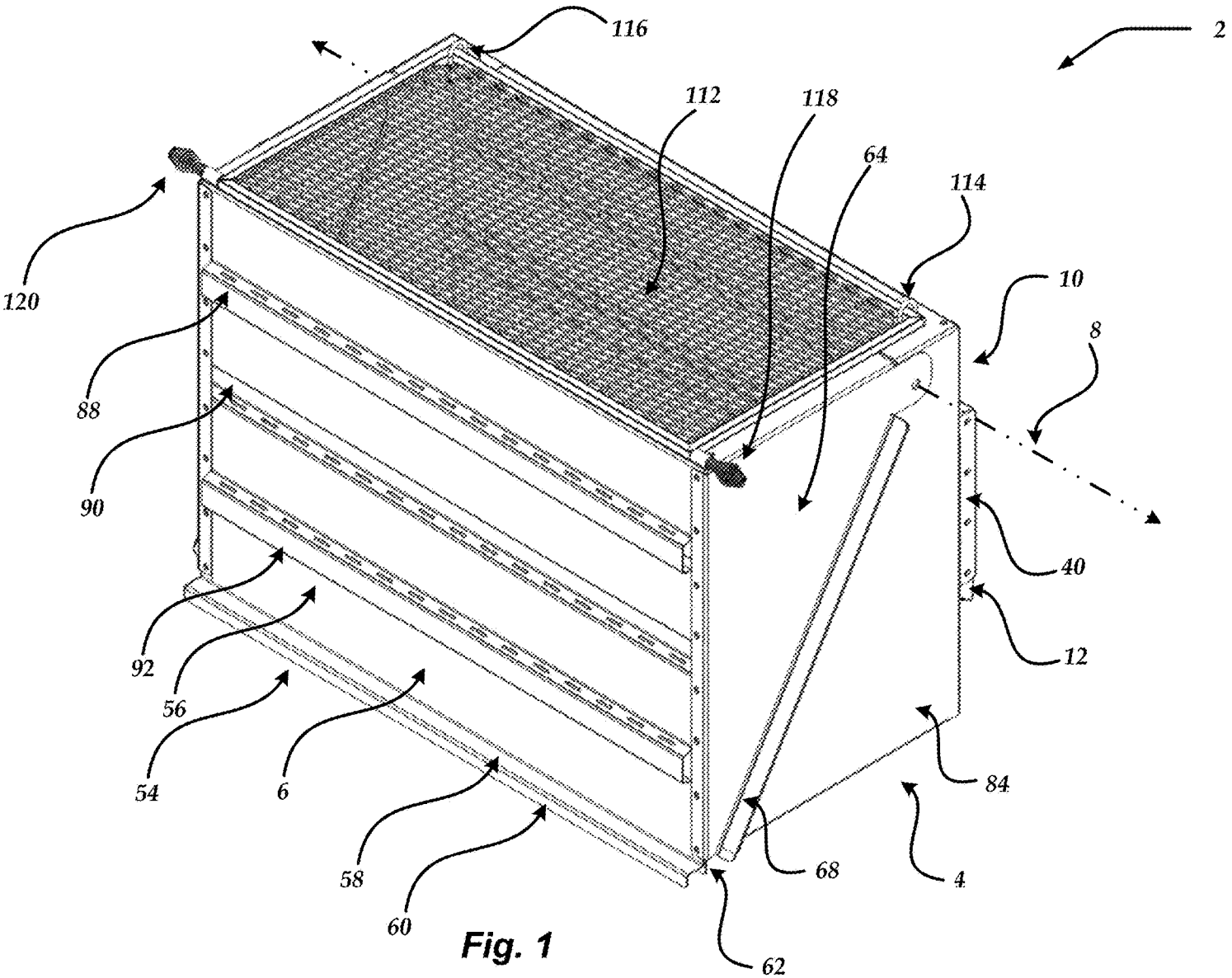
FIG. 1 is a front-left isometric view of a preferred burn bucket in a closed configuration.
Figure 2:
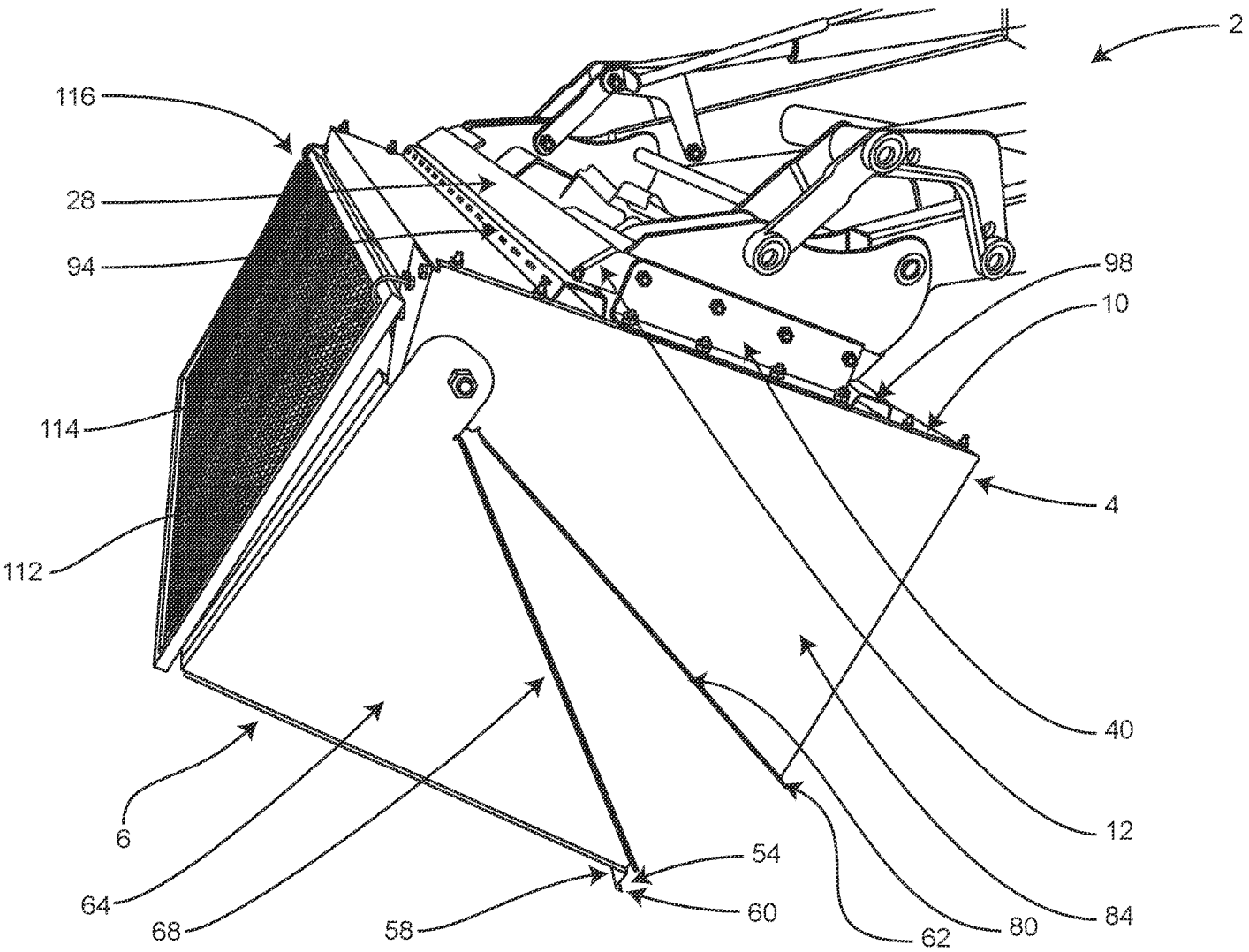
FIG. 2 is a left perspective view of the burn bucket of FIG. 1 in a dumping configuration.
Figure 3:
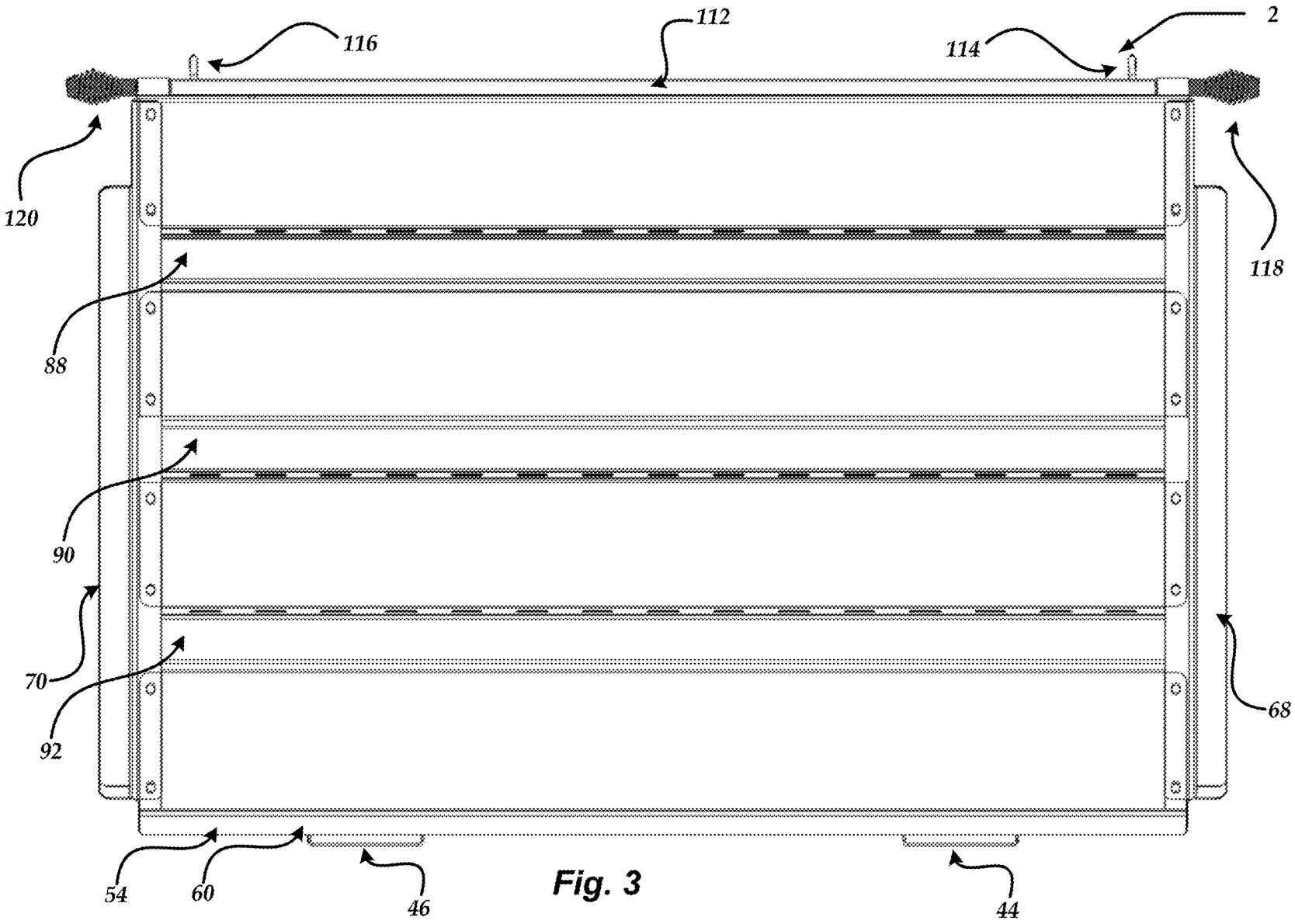
FIG. 3 is a front elevational view of the burn bucket of FIG. 1 in the closed configuration.

A preferred burn bucket 2 in accordance with the principles of the invention is shown in FIG. 1. The burn bucket 2 preferably has a body 4 that holds material when the burn bucket 2 is in a closed configuration as shown in FIGS. 1 and 3-8 to facilitate safely burning the material in the burn bucket 2. The burn bucket 2 preferably has a door 6 that movably couples to the body 4. The door 6 preferably pivots about an axis 8 that is offset from the rear wall 10 of the body 4. Accordingly, as shown in FIG. 2, tilting the burn bucket 2 toward the door 6 (for example, toward the front of the burn bucket 2) causes the burn bucket 2 to transition into a dumping configuration in which the door 6 opens to facilitate dumping ash remaining in the burn bucket 2 after the fire burns out (see FIG. 2).

The axis 8 is positioned to achieve the optimal balance between closure of the clamshell configuration of body 4 and the opening of door 6 upon tilting of the burn bucket 2. The weight of the door itself tends to hold the clamshell body 4 in the closed position at horizontal orientations and even with some tilt. Such tendency to a closed configuration is amplified with a pivot axis 8 that is further rearward and/or further downward. Conversely the pivot axis 8 may be positioned further forward and upward to achieve easier opening of the door 6 with less tilt. The optimum pivot axis may be determined based on the material to be held within the burn bucket 2. Secure closure may also be advantageous in some instances with a pin, latch, or other securement holding door 6 secured to body 4.

Figure 6:
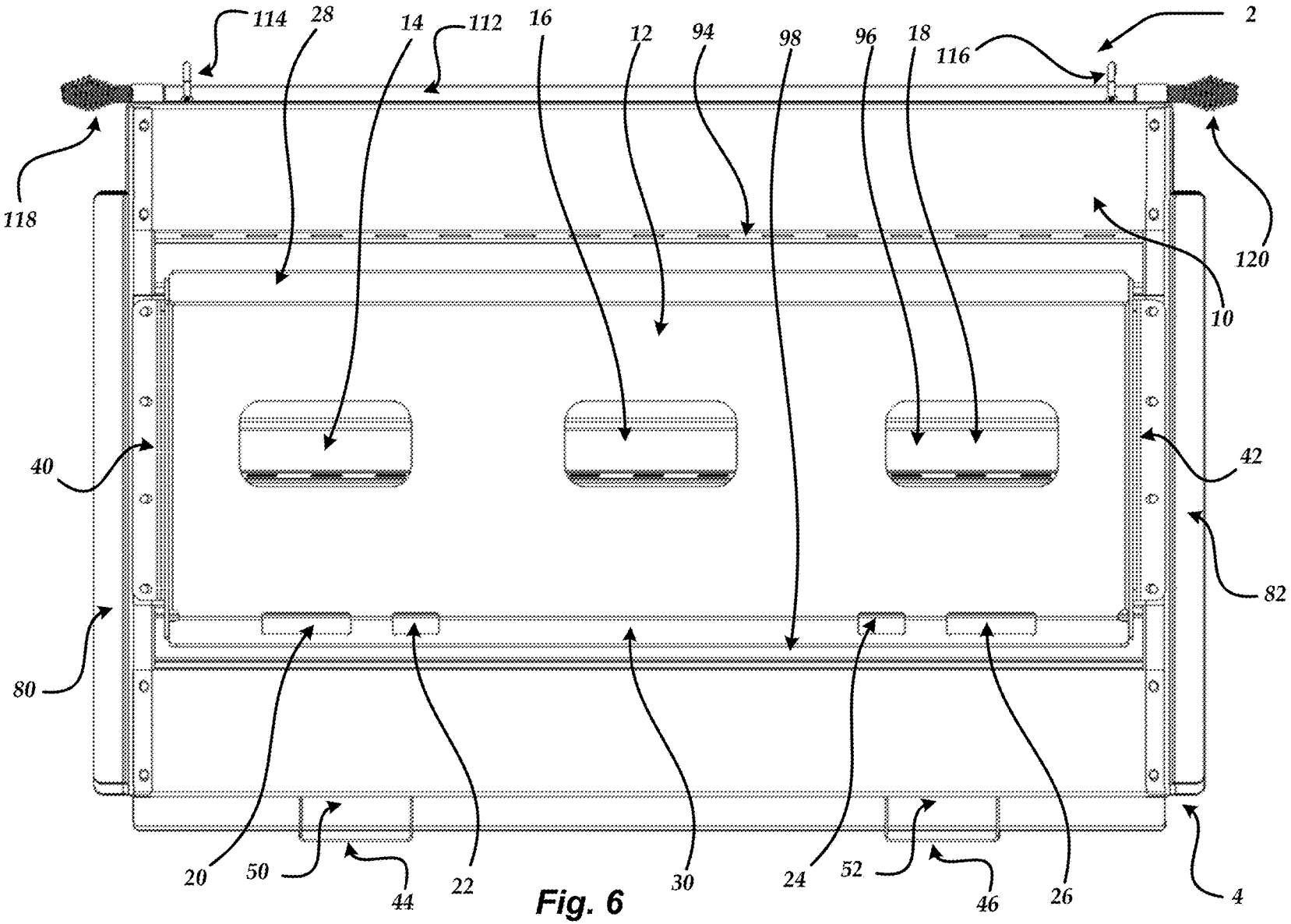
FIG. 6 is a rear elevational view of the burn bucket of FIG. 1 in the closed configuration.
Figure 7:
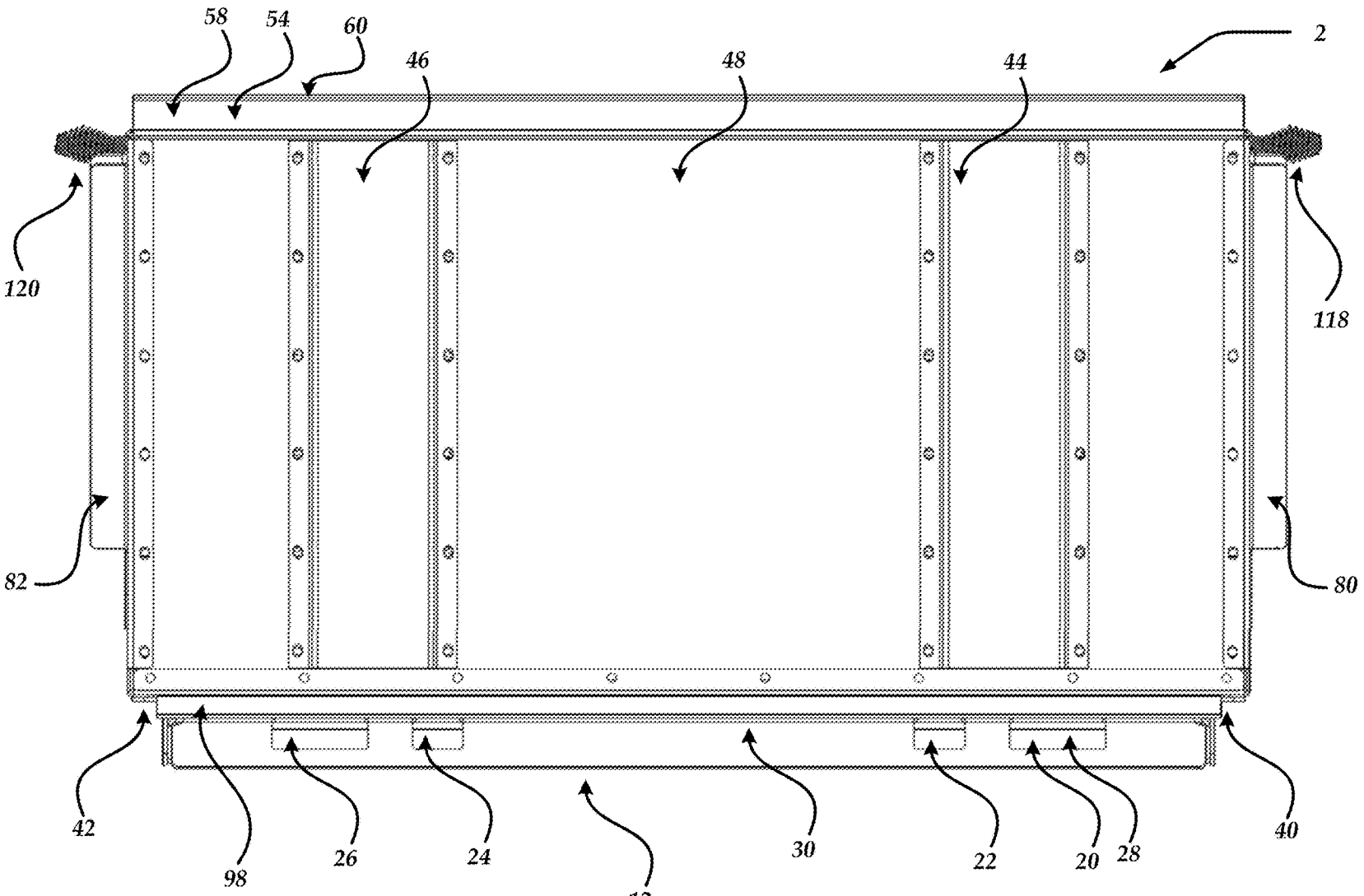
FIG. 7 is a bottom plan view of the burn bucket of FIG. 1 in the closed configuration.
Figure 8:
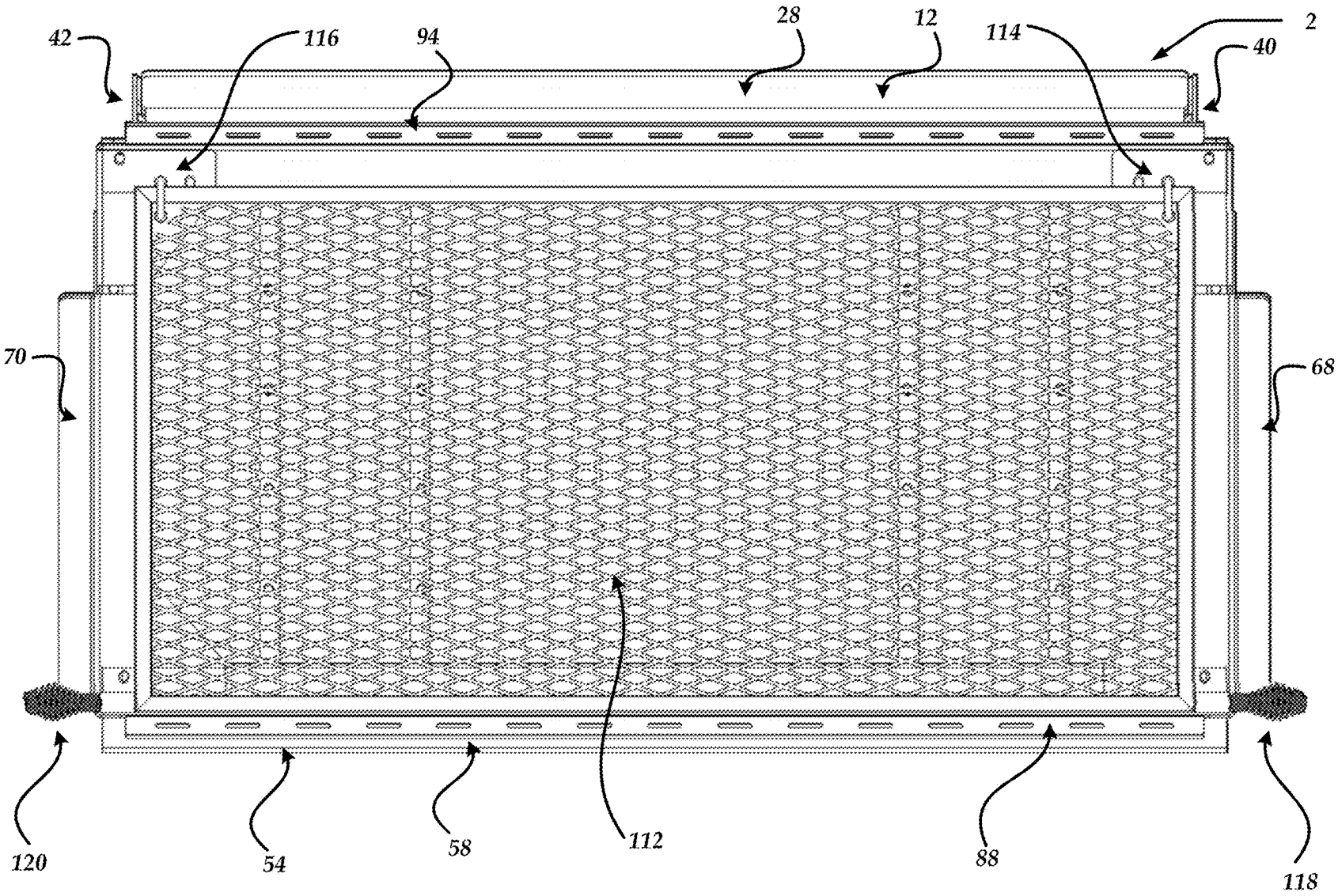
FIG. 8 is a top plan view of the burn bucket of FIG. 1 in the closed configuration.

The burn bucket 2 preferably has one or more lifting machine interfaces that facilitate tilting the burn bucket 2 with standard machinery to facilitate the burn bucket 2 transitioning between the closed configuration and the dumping configuration. As best seen in FIG. 6, the burn bucket 2 preferably has a front-loader coupler 12 configured to receive an American standard coupler of a front loader such as a skidsteer vehicle, thereby effectively making the burn bucket 2 an attached accessory of the front loader and facilitating easy tipping of the burn bucket 2 (see FIG. 2). In some versions, the burn bucket 2 has frame members 44, 46 coupled to the floor 48 of the body 4 (see FIG. 7), and the frame members 44, 46 preferably define forklift channels 50, 52 (see FIG. 6) that are configured to receive the forks of a forklift and thereby facilitate lifting and tilting the burn bucket 2 with the forklift.

As shown in FIG. 6, the front-loader coupler 12 preferably defines numerous openings such as openings 14-26 at different locations or of various sizes to facilitate coupling to different sizes or brands of front loaders. The upper openings 14-18 are preferably configured to receive draw pins of the front loader to facilitate locking the coupler 12 to the coupler of the front loader. The lower openings 20-26 are preferably configured to receive bucket couplers of the front loader. The front-loader coupler 12 preferably has an outwardly declined upper lip 28 under which the front-loader coupler 12 is configured to receive the coupler of the front loader, as shown in FIG. 2. The front-loader coupler 12 preferably has an outwardly declined lower lip 30 (see FIG. 6) above which the front-loader coupler 12 is configured to receive the coupler of the front loader, as shown in FIG. 2. The front-loader coupler 12 is preferably coupled to and at least partially spaced apart from the rear wall 10 of the body 4 by one or more spacers, such as L-shaped spacers or stand-offs 40, 42 (see FIGS. 4-6 and 9), which facilitate decreasing or preventing heat distortion of the front-loader coupler 12. Fasteners such as nuts and bolts preferably secure the front-loader coupler 12 to the spacers 40, 42, the spacers 40, 42 to the rear wall 10, or the frame members 44, 46 to the floor 48 of the body 4 rather than welds to further facilitate reducing or preventing heat distortion.

Figure 4:
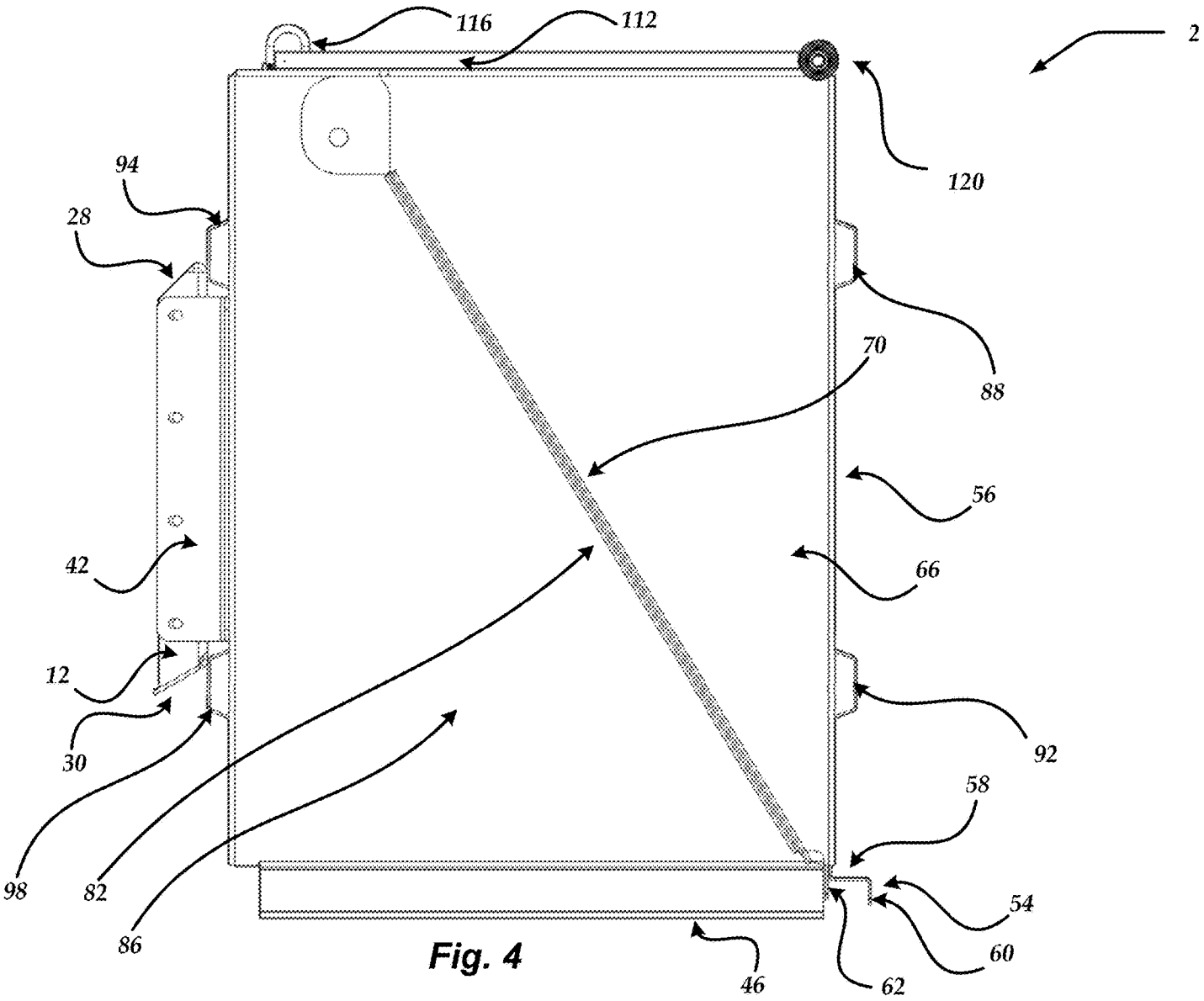
FIG. 4 is a right-side elevational view of the burn bucket of FIG. 1 in the closed configuration.
Figure 5:
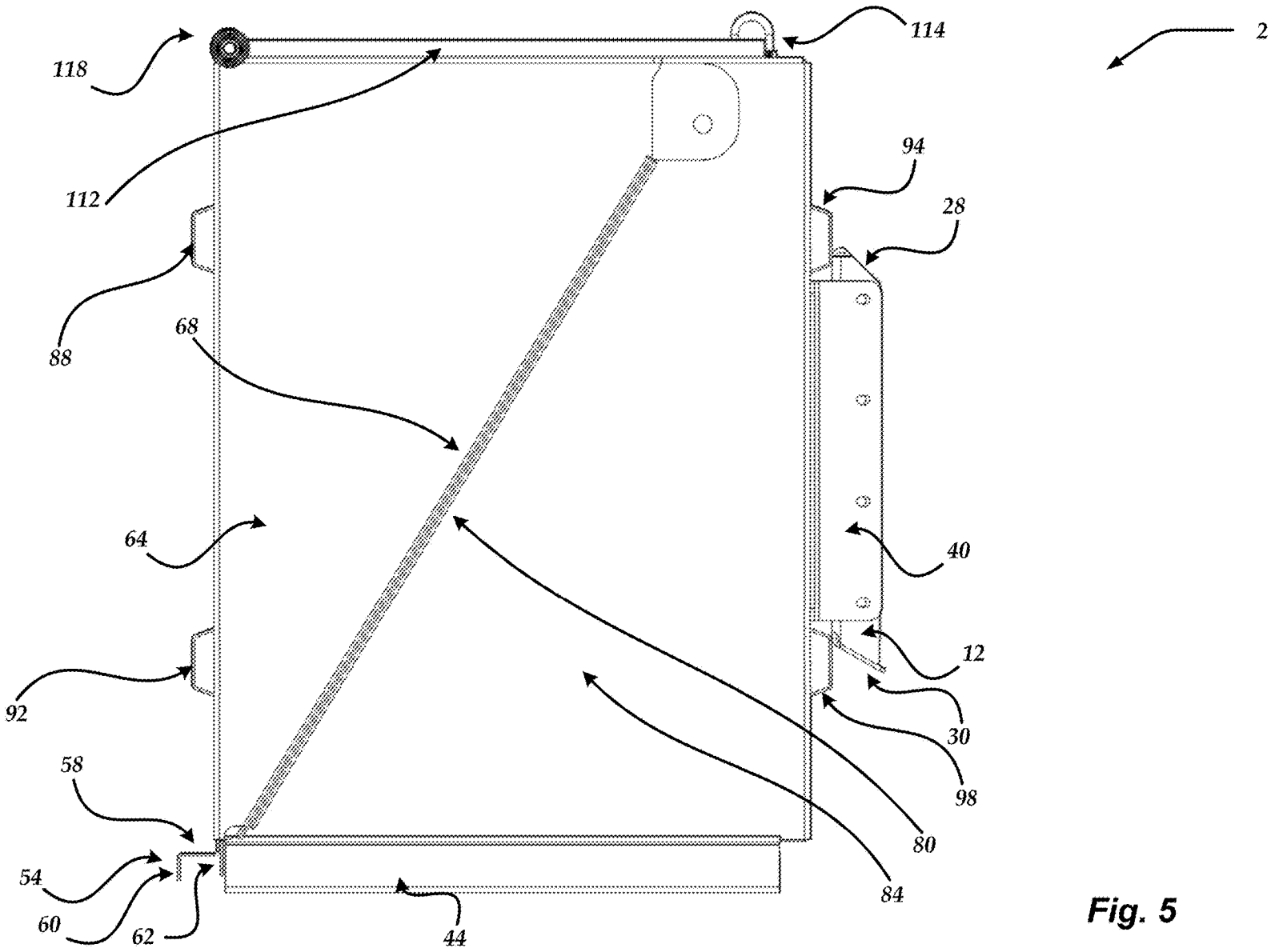
FIG. 5 is a left-side elevational view of the burn bucket of FIG. 1 in the closed configuration.

The burn bucket 2 preferably has one or more additional features that facilitate reducing or preventing heat distortion of the main body and door of the bucket. The door 6 preferably has an L-shaped lip 54 that extends away and downward from the bottom edge of the front main portion 56 of the door 6. As shown in FIG. 4, the L-shaped lip 54 has a substantially horizontal portion 58 that extends away from the front main portion 56 of the door 6 and a substantially vertical portion 60 that extends downward from the outer portion of the substantially horizontal portion 58. Accordingly, the reverse bend in the L-shaped lip 54 preferably facilitates biasing the bottom portion of the front main portion 56 to distort under heat in a direction that is opposite to the direction of heat distortion of the inner bend that transitions from the front main portion 56 to the horizontal portion 58, thereby counteracting the heat distortion of the bottom portion of the front main portion 56.

Figure 9:
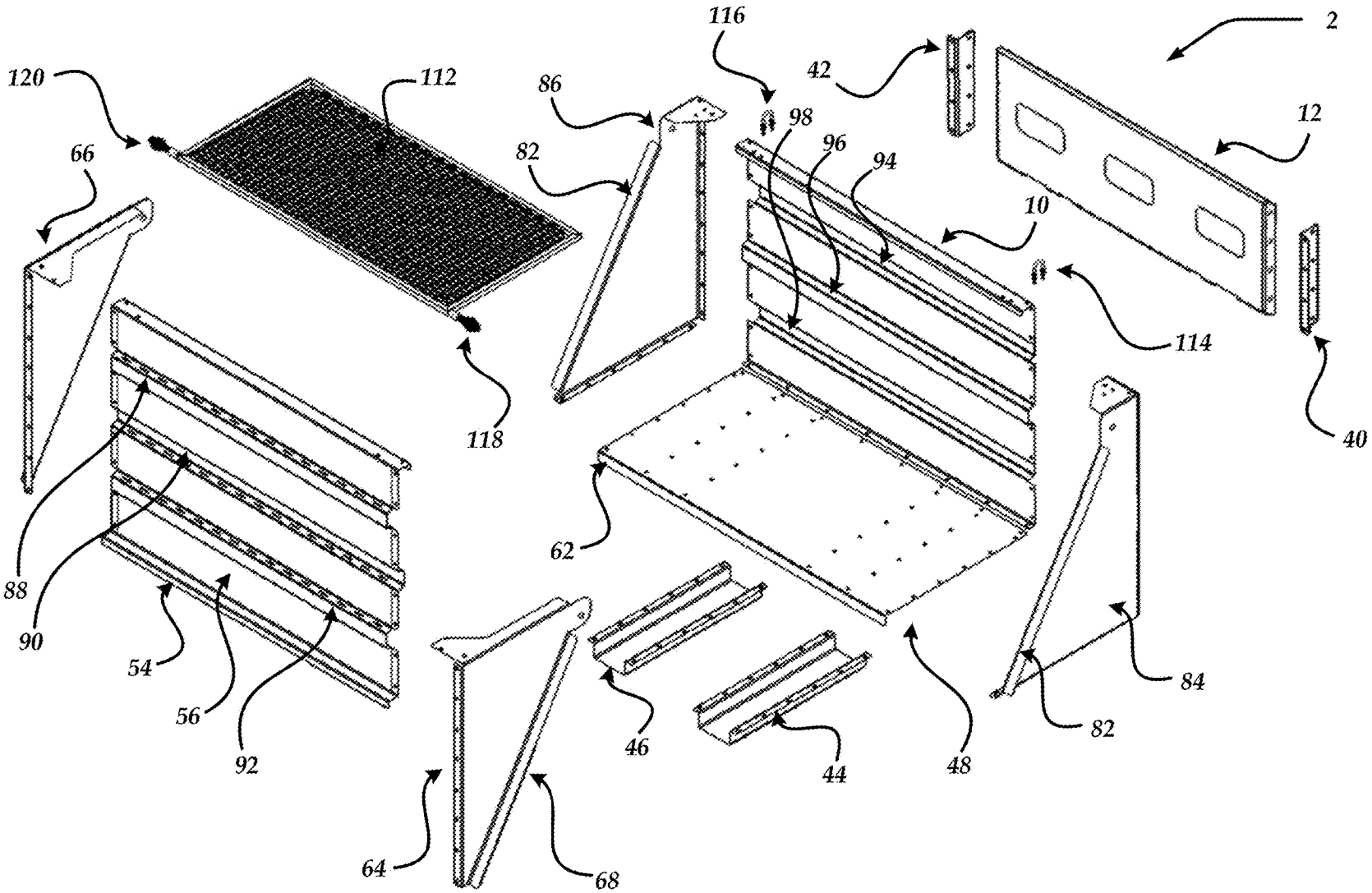
FIG. 9 is an exploded view of the burn bucket of FIG. 1.

As best seen in FIG. 9, the front portion of the floor 48 preferably has an interface flange 62 that extends downward. At least a portion of the interface flange 62 is preferably configured to abut the bottom portion of the front main portion 56 when the burn bucket 2 is in the closed configuration (see FIGS. 1, 4, and 5). The interface flange 62 is preferably configured to facilitate reducing or preventing heat distortion to the floor 48.

As best seen in FIG. 9, the door 6 preferably has a left sidewall portion 64 and a right sidewall portion 66. The left and right sidewall portions 64, 66 of the door 6 preferably have interface flanges 68, 70 that are configured to abut corresponding interface flanges 80, 82 of left and right sidewall portions 84, 86 of the body 4. The interface flanges 68, 70, 80, 82 are preferably configured to facilitate reducing or preventing heat distortion to the respective sidewall portions 64, 66, 84, 86. The interface flanges 68, 70, 80, 82 are preferably disposed at an angle of approximately 58°. The left and right sidewall portions 64, 66 are preferably coupled to the front main portion 56 with fasteners such as nuts and bolts rather than welds to further facilitate reducing or preventing heat distortion. The left and right sidewall portions 84, 86 are preferably coupled to the floor 48 and the rear wall 10 with fasteners such as nuts and bolts rather than welds to further facilitate reducing or preventing heat distortion.

The front main portion 56 preferably has multiple substantially horizontal corrugations 88, 90, 92 (see FIG. 1). As best seen in FIG. 9, the rear wall 10 preferably has multiple substantially horizontal corrugations 94, 96, 98. Preferably every other one of the corrugations such as the corrugations 88, 92, 94, 98 extends outward. Preferably the corrugations between the outwardly extending corrugations extend inward, such as the corrugations 90, 96. The corrugations 88, 90, 92, 94, 96, 98 preferably each define rows of openings distributed along the outwardly facing upper surfaces of the corrugations 88, 90, 92, 94, 96, 98 (upper portions of the outwardly extending corrugations 88, 92, 94, 98 and lower portions of the inwardly extending corrugations 90, 96) to facilitate increasing airflow to fires in the burn bucket 2 without the openings clogging (see FIGS. 1 and 6). In some versions, the ends of the outwardly extending corrugations 88 92, 94, 98 define openings that facilitate increasing airflow to fires in the burn bucket 2 (see FIGS. 2, 4, and 5).

The burn bucket 2 preferably has a screen lid 112 that covers a top opening defined by the burn bucket 2, such as the top opening defined by the body 4 and the door 6. The lid 112 preferably includes a framed mesh screen that is movably coupled to the body 4. U-bolts 114, 116 preferably pivotably couple the screen lid 112 to the body (see FIGS.

1 and 9). One or more handles, such as handles 118, 120, are preferably disposed on the frame of the screen lid 112 opposite the hinges formed by the U-bolts 114, 116. Accordingly, the screen lid 112 can be opened to place materials in the burn bucket 2 for burning and closed to prevent burning ash from raising out of the burn bucket 2.

As best seen in FIG. 9, the rear wall 10, the front main portion 56, and the sidewall portions 64, 66, 84, 86 preferably have upper flanges. The upper flanges preferably extend inward to define surfaces on which the screen lid 112 rests when closed (see FIG. 1). The inwardly extending upper flanges preferably are also configured to reduce or prevent heat distortion.

Appropriate materials for the burn bucket 2 include steel, aluminum, or other non-flammable materials.

As used herein, the following terms take the meanings explicitly associated herein, unless the context clearly dictates otherwise. The term "or" is an inclusive grammatical conjunction to indicate that one or more of the connected terms may be employed. The term "one or more" discloses no more than a single one or more than one, up to and including all. For example, the phrase "one or more A, B, or C" or the phrase "one or more As, Bs, or Cs" is employed to discretely disclose each of the following: i) one or more As, ii) one or more Bs, iii) one or more Cs, iv) one or more As and one or more Bs, v) one or more As and one or more Cs, vi) one or more Bs and one or more Cs, and vii) one or more As, one or more Bs, and one or more Cs. The term "based on" as used herein is not exclusive and allows for being based on additional factors not described. The articles "a," "an," and "the" include plural references. Plural references are intended to also disclose the singular.

The terms "front," "forward," "rear," and "rearward" are defined relative to the rear wall 10 to orient the reader and do not limit the orientation of the burn bucket 2 in a given application. The terms "inner", "inward", "outer", and "outward" are defined relative to the interior volume enclosed by the burn bucket 2. The term "transverse" refers to a non-parallel orientation and includes but is not limited to a perpendicular orientation. The term "configured" refers to an element being one or more of sized, dimensioned, positioned, oriented, or arranged to achieve or provide the recited function or result.

The term "approximately" or "substantially" refers to the described value or a range of values that include all values within 5, 10, 20, 30, 40, or 50 percent of the described value. The term "substantially parallel" refers to parallel or within 5, 10, 15, 20, 25, 30, 35, 40, or 45 degrees of parallel. The term "substantially flush" refers to flush or plane separation of no more than 5, 10, 15, 20, 25, or 30 percent of a substantially parallel dimension of the relevant component.

The term "directly coupled" refers to a component that contacts (for example, when bolted) or is welded to another component. The term "indirectly coupled" refers to a component that is coupled to one or more other components that are coupled to a second component or one or more further components that are coupled to the second component. The term "coupled" should be understood to disclose both direct and indirect coupling of components or elements that are described as being coupled to each other.

While the preferred embodiment of the invention has been illustrated and described, as noted above, many changes can be made without departing from the spirit and scope of the invention. For example, each disclosure of an element or component preferably having a feature or characteristic is intended to also disclose the element or component as being devoid of that feature or characteristic, unless the principles of the invention clearly dictate otherwise. Accordingly, the scope of the invention is not limited by the disclosure of the preferred embodiments. Instead, the invention should be determined entirely by reference to the claims that follow. Moreover, each feature, characteristic, element, or component described herein may be implemented in combination with one or more other features, characteristics, elements, or components described herein. It should also be noted that the claim dependencies or combinations of elements recited in the claims does not reflect an intention to forgo claiming other subject matter disclosed herein. Instead, this disclosure is intended to also disclose the subject matter of any combination of any two or more of the claims, such that subsequent claim sets may recite that any one of the dependent claims depends from any other one or more claims, up to and including all other claims in the alternative (for example, "The burn bucket 2 of any one of the preceding or subsequent claims . . . ."). This disclosure is also intended to disclose the subject matter of any one of the dependent claims, as if it was an independent claim, with or without all or a portion of the subject matter of the original independent claim(s) or any other subject matter disclosed herein.

We claim:

1. A burn bucket comprising:

a body that defines an inner burn space, the body having right and left sides, a back, and a bottom;

a door moveably coupled to the body, the door and the body forming a clamshell configuration when closed together with the interface between the door and the body extending generally diagonally relative to the bottom of the body when the bottom of the body is oriented generally horizontal; and a lifting machine interface that is coupled to the back of the body and configured to receive a portion of a machine that tilts the burn bucket to transition the burn bucket between a closed configuration in which the door is closed and a dumping configuration in which the door is open to facilitate dumping burnt material out of the inner burn space.

2. The burn bucket of claim 1, wherein the lifting machine interface includes a front-loader coupler.

3. The burn bucket of claim 2, further comprising a spacer that spaces the front loader-coupler apart from the body to reduce heat distortion.

4. The burn bucket of claim 1, wherein the lifting machine interface includes a pair of forklift channels.

5. The burn bucket of claim 1, wherein the bottom of the body forms has a floor, the burn bucket being in the closed configuration when the floor is substantially parallel to horizontal, the burn bucket being in the dumping configuration when the floor is tilted toward vertical and within 80° from horizontal.

6. The burn bucket of claim 1, wherein the door pivotably couples to the body, the burn bucket having a front surface and a rear surface, the door being pivotable about an axis that is disposed between the front surface and the rear surface.

7. The burn bucket of claim 6, wherein the axis is spaced apart from the rear surface and closer to the rear surface than the front surface.

8. The burn bucket of claim 1, wherein the body and the door form a cuboid in the closed configuration, the cuboid having a front side, a rear side, a left side that extends from the rear side to the front side, and a right side that extends from the rear side to the front side, the door defining the front side, approximately half the left side, and approximately half the right side.

9. The burn bucket of claim 1, wherein the door has a front portion, a left side portion that extends rearward from the front portion, and a right side portion that extends rearward from the front portion, each of the left and right side portions having a lower edge portion that has an interface flange to reduce heat distortion.

10. The burn bucket of claim 9, wherein the interface flanges are disposed at approximately 60°.

11. The burn bucket of claim 1, wherein the door has a lower edge portion that has an outwardly extending flange and a flange that extends downward from the outwardly extending flange to reduce heat distortion.

12. The burn bucket of claim 1, wherein the body has a floor, the floor having a front edge portion that has an interface flange to reduce heat distortion.

13. The burn bucket of claim 1, wherein the body or the door has a plurality of corrugations disposed spaced apart from each other in a row and substantially parallel to each other.

14. The burn bucket of claim 13, wherein two of the corrugations both extend in an outward or inward direction and one of the corrugations is disposed between the two corrugations and extends in an opposite inward or outward direction from the two corrugations.

15. The burn bucket of claim 14, wherein each outwardly extending corrugation has an upper portion that defines a plurality of openings to facilitate providing airflow to a fire in the inner burn space and a lower portion that is devoid of openings.

16. The burn bucket of claim 14, wherein each inwardly extending corrugation has a lower portion that defines a plurality of openings to facilitate providing airflow to a fire in the inner burn space and an upper portion that is devoid of openings.

17. The burn bucket of claim 1, further comprising a screen lid moveably coupled to the door and selectively providing access to the inner burn space to facilitate placing burnable material in the inner burn space, each of the body and the door having an upper edge portion that has a flange that defines a support surface on which the screen lid rests in the closed configuration.

18. The burn bucket of claim 1, wherein the body and the door are devoid of welds.

19. The burn bucket of claim 1, wherein the interface between the door and the body forms a generally straight line on right and left sides of the burn bucket.

* * * * *